US005494787A

United States Patent [19]

Sawyer

[11] Patent Number: 5,494,787

[45] Date of Patent: Feb. 27, 1996

[54] PHOTOSENSITIVE ELEMENT COMPRISING A NON-SILVER HALIDE PHOTOSENSITIVE LAYER AND A REFLECTING LAYER COMPRISING INDIUM OR GALLIUM

[76] Inventor: George M. Sawyer, 3135 W. 110th St., Englewood, Calif. 90303

[21] Appl. No.: 367,777

[22] Filed: Dec. 30, 1994

Related U.S. Application Data

[63] Continuation of Ser. No. 39,508, Mar. 29, 1993, abandoned, which is a continuation of Ser. No. 784,612, Oct. 29, 1991, abandoned, which is a continuation of Ser. No. 436,378, Nov. 14, 1989, abandoned, which is a continuation of Ser. No. 924,156, Oct. 27, 1986, abandoned, which is a continuation of Ser. No. 699,504, Feb. 8, 1985, abandoned, which is a continuation of Ser. No. 539,640, Oct. 5, 1983, abandoned, which is a continuation of Ser. No. 348,610, Feb. 12, 1982, abandoned, which is a continuation of Ser. No. 72,209, Sep. 4, 1979, abandoned, which is a continuation of Ser. No. 72,197, Sep. 14, 1970, Pat. No. 4,178,181, which is a continuation of Ser. No. 544,275, Apr. 21, 1966, abandoned.

[51] Int. Cl.[6] ..... G03C 1/77; G03C 7/00

[52] U.S. Cl. ..... 430/524; 430/1; 430/367; 430/395; 430/290; 430/950

[58] Field of Search ..... 430/1, 367, 290, 430/524, 950, 568, 395

[56] References Cited

U.S. PATENT DOCUMENTS

| | | | |
|---|---|---|---|
| 2,595,670 | 5/1952 | Goehner | 430/14 |
| 2,692,830 | 10/1954 | Land | 430/227 |
| 3,107,170 | 10/1963 | Netke | 430/388 |
| 3,503,050 | 3/1970 | Schools et al. | 430/1 |
| 4,054,453 | 10/1977 | Grobin | 430/524 |
| 4,178,181 | 12/1979 | Sawyer | 430/395 |

FOREIGN PATENT DOCUMENTS

| | | | |
|---|---|---|---|
| 326781 | 3/1930 | United Kingdom | 430/524 |

OTHER PUBLICATIONS

*The British Journal of Photography,* May 21, 1895 vol. 42, pp. 342–343.

Connes, "Silver Salt's . . . Photography", J. Optics 1987, Paris, vol. 18, No. 4, pp. 147–166.

Glafkides, Photographic Chemistry, vol. 2, pp. 546–547, Fountain Press, London, 1960.

Popular Photography, Mar. 1965, pp. 62–63 and 98–99.

British Journal of Photography, May 31, 1895, pp. 342–343.

British Journal of Photography, Mar. 16, 1900, p. 167.

British Journal of Photography, Supplement, Apr. 6, 1900, pp. 31–32.

British Journal of Photography, Sep. 14, 1900, pp. 583–584.

British Journal of Photography, Feb. 15, 1901, pp. 100–101.

British Journal of Photography, Mar. 22, 1901, p. 180.

British Journal of Photography, Jul. 12, 1901, pp. 439–441.

British Journal of Photography, Supplement, Jan. 3, 1919, p. 4.

*Primary Examiner*—Richard L. Schilling

[57] ABSTRACT

This invention involves improvements in interference film photography including the use of indium or gallium reflecting layers.

3 Claims, 2 Drawing Sheets

PHOTOSENSITIVE ELEMENT COMPRISING A NON-SILVER HALIDE PHOTOSENSITIVE LAYER AND A REFLECTING LAYER COMPRISING INDIUM OR GALLIUM

This is a continuation of application Ser. No. 08/039,508, filed on Mar. 29, 1993, now abandoned, which is a continuation of application Ser. No. 07/784,612, filed on Oct. 29, 1991, now abandoned, which is a continuation of application Ser. No. 07/436,378, filed on Nov. 14, 1989, now abandoned, which is a continuation of application Ser. No. 06/924,156, filed Oct. 27, 1986, now abandoned, which is a continuation of application Ser. No. 06/699,504, filed Feb. 8, 1985, now abandoned, which is a continuation of application Ser. No. 06/539,640, filed Oct. 5, 1983, now abandoned, which is a continuation of application Ser. No. 06/348,610, filed Feb. 12, 1982, now abandoned, which is a continuation of application Ser. No. 06/072,209, filed Sep. 4, 1979, now abandoned, which is a continuation of application Ser. No. 05/072,197, filed Sep. 14, 1970, now U.S. Pat. No. 4,178,181, which is a continuation of application Ser. No. 05/544,275, filed Apr. 21, 1966, now abandoned.

This invention relates generally to interference film photography and more particularly to improvements extending the utility of such photography.

The so-called Lippmann method of color photography is based on the interference principle. In this process a black and white film is used but of such fine grain that the film is capable of producing minute layers separated at half the wave length of the incident light. The colors do not originate as a finite volume of colored substance, but originate from interference effects. When a Lippmann photograph is examined no colored dye or pigment exists in the emulsion.

The Lippmann colors are only visible in the direction of specular reflection, whereas dyed particles are visible by incident light rays coming from any direction. If it is desired to know by which process the color originates, it is only necessary to tilt the photograph. Pigments or dyes remain visible and of the same color under every direction of observation and the same colors are observed by transmitted or reflected light. Lippmann colors on the other hand, are seen only in the direction of specular reflection, and colors change with incidence. By moistening the film, the colors change, shifting toward the reds.

Lippman coated a glassplate with a photographic emulsion (with an extremely fine grain), the emulsion being covered with a layer of mercury to form a reflecting surface. When the plate (or film) is placed in the camera, the glass plate side is toward the lens. After exposure and development, the plate contains a number of layers of silver located at the anti nodes, or places where incident and reflected waves reinforces. These layers are parallel to the mirror surface. If the plate is then illuminated with white light and viewed by reflection, the silver layers will reflect only the color (or colors) by which they were originally formed. Each silver layer by itself is so thin as to reflect only a small amount of light, but these beams then combine so as to reinforce one another's effects, giving rise to an intense reflection for this particular color. It may appear controdictory at first, that although each silver layer reflects nearly equal amounts of all colors, that one particular color should predominate to a great extent in the reflected light. An example may make this point clearer. It will be recalled that the intensity of a sinusoidal wave is proportional to the square of its amplitude. The resultant intensity of a number of wave trains, if there is no phase relation between them, is found by adding the squares of the intensities of the individual wave trains. But if the wave trains are all in phase, the resultant intensity is found by adding the amplitudes of the individual waves and squaring to obtain the resultant intensity.

Assume for instance that we have three wave trains to combine, each of amplitude 2 (arbitrary units). If the phase relation between them is random, we first compute the intensity of each wave which is 2 or 4 and add intensities, giving 12 (arbitrary units) as the resultant intensity. If the three wave trains are in phase, however, they combine to produce a wave of amplitude 6 and by squaring, a resultant of 36 is obtained.

Lippmann's color photographs are extremely brilliant, but the plates are difficult to prepare and of course no prints can be made from them. The general object of this invention is to improve some of the shortcomings of interference film photography, and to raise this laboratory curiosity out of the depths of obscruity. In the discussion which follows some of the shortcomings of previous methods will be recapitulated and improvements discussed.

These and other objects and advantages of the invention, as well as the details of illustrative embodiments, will be more fully understood from the following detailed description of the drawings in which.

Figure 1:
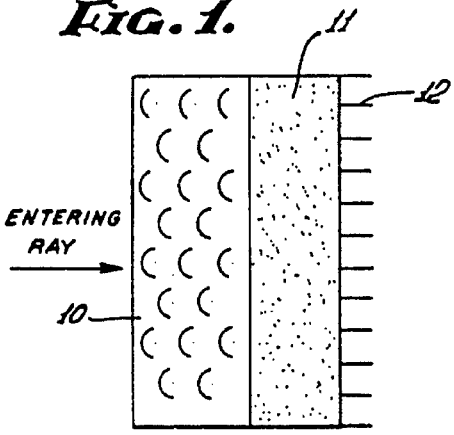
FIG. 1 is an illustration of the standard Lippmann process.

In the standard Lippmann process, a piece of glass coated with emulsion is placed with the emulsion surface against mercury. By referring to FIG. 1, this arrangement is depicted with the light entering from the left. The film is shown in cross section. In FIG. 1, as well as in the claims, the term "arrangement sequence" refers to the sequence of layers used in the film, and the convention used is to start with the layer the incoming ray first strikes. Hence, the "arrangement sequence" for the standard Lippmann film, as shown in FIG. 1, is glass, emulsion, mercury. Inasmuch as materials other than glass and mercury are proposed, a more generalized terminology is sometimes used. By using this generalized terminology, the arrangement sequence of layers would be, by referring to FIG. 1, transparent material 10, emulsion 11, and reflecting material 12.

The use of mercury as a reflecting material has the disadvantage that the metal and its vapors are toxic; metal may not be left in contact with the emulsion over long periods of time; it has a high vapor pressure and is difficult to work with.

According to U.S. Pat. No. 3,107,170, "The major disadvantage of the widespread acceptance of the Lippman method lies in the necessity in connection therewith of using a mirror face (reflecting surface) of liquid mercury. Each sensitive plate supporting member must be constructed in the form of a tank into which the liquid must be introduced before each exposure. Thus, for practical operation, the Lippmann method is wholly unsuitable. It is an important laboratory tool, however, and must remain as such."

Another liquid metal that may be used in combination with the photographic emulsion and transparent materials, without some of mercury's disadvantages, is gallium with a melting point of 29.8° C. and the ability to commonly super cool. The vapor pressure at ambient temperatures is exceedingly low. Gallium is silvery white with a bright mirror surface resembling mercury. The hardness is 1.5 on the Moh's scale of hardness.

Indium, which is usable in its solid state, has the interesting property of adhering to other surfaces when rubbed across them and forming a reflecting surface; it is a soft metal and may easily be scratched with the fingernail. This material as well as gallium, may be rubbed over the film to leave material deposited thereon to form the reflecting surface. A protective coating may be applied over reflecting surfaces of indium to keep them from deteriorating.

Although Lippmann used a rigid transparent material (glass) as an emulsion support and as a container wall to hold the mercury, rigidity is not required when a liquid metal is not used. By using a flexible transparent emulsion support, an interference film results that is unbreakable and may be used in a manner similar to presently marketed photosensitive materials. A polyester base may be used as such a support.

In the Lippmann arrangement sequence, (air, transparent material and emulsion support, emulsion, reflecting material) the mercury may be replaced by reflecting material applied to the emulsion surface; the reflecting layer is thus supported by the emulsion, and hence mechanical strength of reflecting material is not required. A thin layer of transparent material may separate the emulsion from the reflecting surface. The function of this material may be to aid in separating the reflecting material from the emulsion after the emulsion has been exposed. Reflecting materials suitable for application directly to the emulsion would be paint (metallic particles may be dispersed in rubber cement, as for example Venus 53 metallic particles mixed into Carter's rubber cement), or a metal (as indium) may be rubbed or dream on the surface with enough metal adhering to form a reflector, or the surface may be metallized by various means including by evaporation (aluminum may be evaporated by heating on a vacuum chamber where the pressure is 10 Torr or less) chemical deposition, exploding wires, or sputtering. (These procedures are detailed in *Procedures in Experimental Physics* by Strong, C. L) Coating by a material of high refractive index such as titanium dioxide and other materials will result in a highly reflecting surface. Evaporated layers of titanium may be heat oxidized in an oxygen environment, and bismuth oxide may be formed by sputtering. After exposure, the reflecting material may be removed by a solvent. Aluminum may be removed by a caustic soda solution containing 10% caustic $N_aOH$. Some paints may be removed by acetone. Materials of poor mechanical strength may be separated by physical force, as a reflective Scotch adhesive tape may be stripped from the film by peeling it off.

Although both the emulsion and reflecting material are on the same side of the transparent emulsion support in the standard Lippmann arrangement sequence (see FIG. 1), there are advantages in placing the emulsion and reflection material on opposite sides of a mechanically strong transparent material. These advantages arise from the method of manufacturing the film and in the processing of the exposed film. For example, a reflecting surface of aluminum may be applied to a transparent material such as glass or Mylar by thermal evaporation in a vacuum chamber. The brilliance of the evaporation filament would partly expose the emulsion; hence, the emulsion may be applied after the aluminizing and on the opposite side of the transparent material from the reflecting material. After exposure, the aluminum may be removed by sodium hydroxide and the emulsion processed. During exposure, dimensional stability in the thickness of the transparent material is desired.

Figure 2:
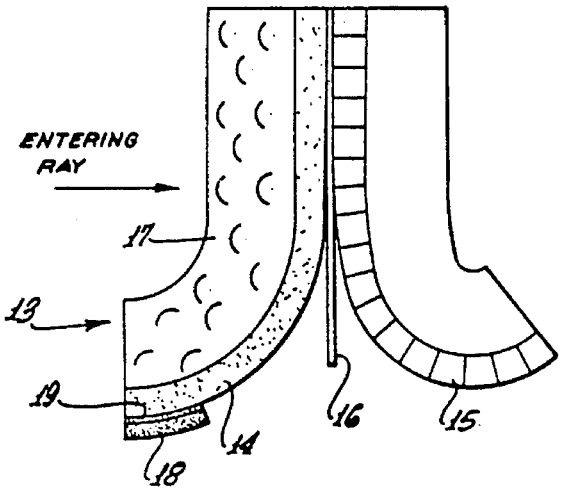
FIG. 2 is a view like FIG. 1, but showing emulsion and reflecting layers separated by a film allowing separation of the layers.

The emulsion may be coated on a reflecting material which is strong enough to also serve as an emulsion support; this procedure requires (after exposure) separating the emulsion from the reflecting material which acted as a support and transferring the emulsion to another support. This procedure is complicated by the lack of dimensional stability of the emulsion layer, and the difficulty of separating the emulsion from the reflecting material. This problem may be solved as follows: After exposing an interference film, where the emulsion may be transferred by gluing to the emulsion a new surface, and by various means the emulsion may be loosened from the old surface. For example, as seen in FIG. 2, if an interference film 13 is made by an emulsion 14 attached to a reflecting foil or reflecting material 15 (but separated from it by a loosenable film 16 as a glue or adhesive), and then exposed, a sheet of material 17 may be glued to the side of the emulsion away from the reflecting surface, and then the emulsion may be separated from the foil or reflecting material by loosening the loosenable material 16. A method of providing mechanical strength to the emulsion may be accomplished by supporting the emulsion with a transparent material 17, if the latter is to be in place during exposure, or material 17 may be opaque if not in place during exposure (see FIG. 2). During exposure the arrangement sequence may be (1) air, transparent material, emulsion, reflecting material, reflector support or (2) air, emulsion, transparent material, reflecting material, reflector support. Other coatings and other arrangement sequences may be used.

The result is two separable units (see FIG. 2). One of the layers is strong enough to support the emulsion layer and the other layer strong enough to support the reflecting material. The emulsion is thus made mechanically strong when separated from the reflecting material. The reflecting material may be foil, plate or metallized surface, etc. In this regard, front surfaced and rear surfaced mirrors are available from Edmund Scientific, Barrington, N.J. Although metallized surfaces are the most common type of reflecting surface, dielectric reflectors are also available. Dielectric reflectors are manufactured by depositing thin films of selected refractive indices and thickness in a vacuum chamber onto glass substrates. These may be purchased from Optical Coating Labs, Inc., Santa Rosa, Calif.

The two separable units may be held fixed with respect to each other during exposure by cohesion, adhesion or by various means as mechanical, pneumatic, hydraulic, or may have a material ("glue") between the units as a viscous fluid (water is not included), a soluble material, meltable material, or a pressure sensitive material. Examples of "glues" are collodian, waxes, resins, gelatin, styrene, glycerine and oil. By the use of these materials or others, a transparent film is located between the emulsion and reflecting subassemblies.

After an interference film is exposed and fixed, the parts of the film corresponding to black in the subject are unexposed, and hence transparent. The parts of the film that correspond to a color in the subject are exposed as minute layers. These layers are essentially parallel to the reflecting surface. When the film is oriented with respect to the light source so that reflection occurs from the "colored" minute layers, reflection also occurs all over the film from both the front and the back surfaces due to the change in the index of refraction across the interfaces. When viewing a colored photograph which uses dyes rather than interference film, the colors are the same regardless of the direction from which they are viewed, and to eliminate specular reflection of the light source from the surface, it is merely necessary to change the viewing angle. However, when viewing an interference film photograph, the conditions are quite different. Colors are only seen when they form a specular reflection of the light source, and when this occurs unwanted reflections from the film surfaces simultaneously take place it is not possible to merely change the viewing angle to eliminate the surface reflections because when the surface reflections are reduced, so are the colored reflections from the interference photograph simultaneously reduced. Hence, it is unusually important to eliminate or reduce surface reflections, from both front and back surfaces of interference photographs.

After an interference film has been exposed and fixed, it may be observed from either the side that was toward the lens or from time side that was away from the lens. When discussing the reflections from a photograph, the terms "front" and "back" side refer to the side of the photograph toward or away from the observer respectively as he currently is viewing the photograph, and does not refer to the surface position with respect to the lens during exposure.

Black paper, plushy material, or a black surface 18 may be used in back of the photograph so that black parts of the subject appear black by looking through the interference photograph into the black backing. In order to prevent reflections from the back surface and enable the observer to look directly into the black surfaced material without the back surface causing reflections, the back surface may be coated with anti-reflection coatings. These coatings are able to reduce surface reflections from 4% to ½ of 1%. Optical Coating Labs, Inc. of Santa Rosa, Calif. produces these coatings. Black varnish or paint has been applied directly to the back surface (the surface away from the observer) of the photograph to prevent reflections from the back surface. However, this painting requires that the photograph be rigid enough to support the paint, for paint is formless and assumes the shape of the article to which it is applied. Painting can be inconvenient and messy, for it requires brush cleaning and solvents. A more convenient method of reducing back surface reflections is to use a sheet surfaced with dark material (paint,paper, fibrous material, etc.) However, a sheet of such dark material leaves between it and the back surface of the film an air-film interface which reflects light where only absence of light should be. This undesired interface is destroyed or reduced by introducing a clear substance 19, preferably of the same index of refraction as the photograph material it comes in contact with, that envelopes the light absorbing material and is in intimate contact with the photograph surface. This sheet may be rigid enough to perform a stiffening function for the photograph. An example of a conveniently applied sheet is a black surfaced cardboard covered with pressure sensitive adhesive film. The black surfaced sheet may be also attached with collodian, or with Canada balsam, etc.

The reflection from the front surface of the film also interferes with color viewing. This reflection may be reduced by applying a non-reflecting film to such front surface. Optical Coating Labs of Santa Rosa, Calif. produce these coatings.

After the interference photograph has been fixed, undesired reflections from the front and back surface may be greatly reduced by sandwiching the photograph between two pieces of glass, said pieces of glass having anti-reflection coatings on the outside of the sandwich. Transparent material (as Canada balsam) bonds the photograph and glass sheets together into a solid assembly that is very transparent in areas where the photograph is unexposed. Black backing completes the assembly.

Figure 3:
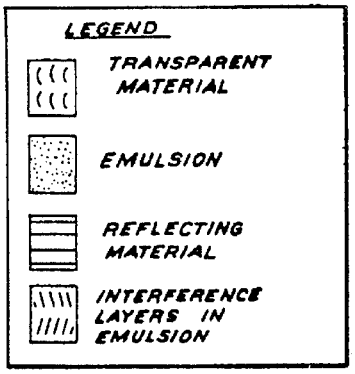
FIGS. 3 and 3A–3E illustrate methods of reducing front surface reflections from interference films.
Figure 3A:
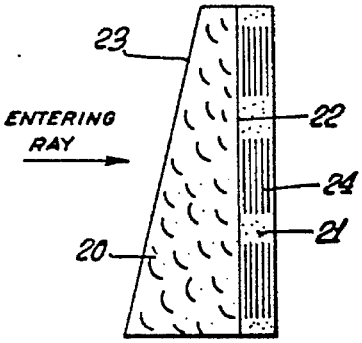
Figure 3B:
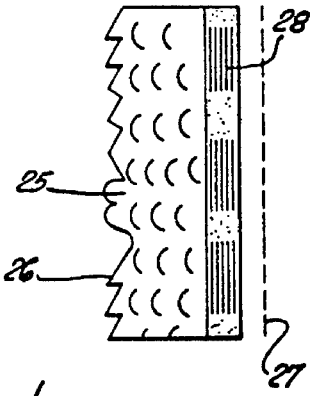
Figure 3C:
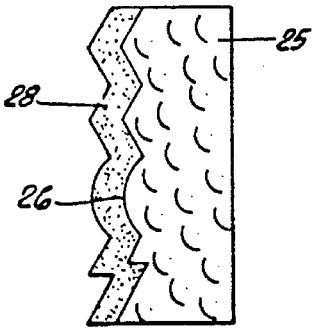
Figure 3D:
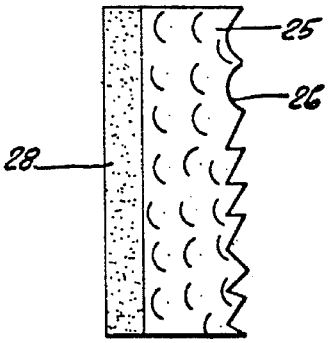
Figure 3E:
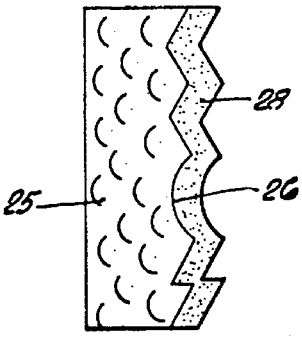

One method of reducing the distracting front surface reflections is to apply a wedge 20 of transparent material to the film or emulsion 21 by Canada Balsam adhesive 22 (see FIG. 3A). The wedge surface 23 and the minute interference layers 24 are then no longer parallel, and the photograph may be oriented so that the desired reflections from the minute layers are seen and the undesired reflections from the front surface are not seen. A disadvantage of the wedge is that it has one corner that is thick, and the thickness makes the unit heavy, stiff and distortions of the image increase as the thickness increases. Methods of avoiding the thick wedge disadvantages follow: The thickness may be vastly reduced by covering the entire front surface of transparent material 25 with small surfaces 26 angled with respect to the reflecting surface 27 which existed at the time of exposure (see FIGS. 3B, 3C, 3D, 3E). The emulsion is seen at 28.

Figure 4A:
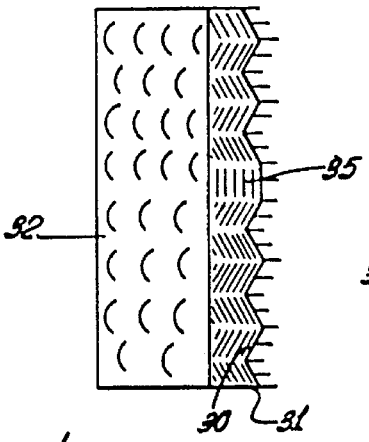
FIGS. 4A–4C illustrate methods of achieving multiple reflecting surfaces so as to decrease the criticality of the viewing angle with respect to the position of the light source, viewer and orientation of the photograph.
Figure 4B:
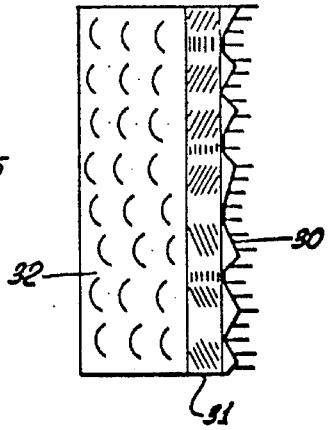
Figure 4C:
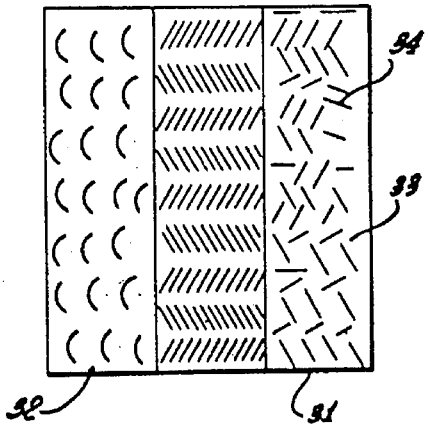

One of the disadvantages of the standard Lippmann photograph is that the viewing angle is critical with respect to the light source. Lippmann reported that the colors are visible only in the direction of specular reflection, and are invisible in every other direction. One method of decreasing the sensitivity to orientation change is to eliminate a reflecting material, flat, continuous and shiny in nature, and use instead a multiplicity of reflecting surfaces. One particular method of achieving a multiplicity of reflecting surfaces is to use a foil with its surface formed into a multiplicity of reflection surfaces. Tiny rounded bumps, flat or irregular reflecting surfaces 30 may be used on film 31 to which transparent material 32 is attached (see FIGS. 4A and 4B). Interference layers 35 are parallel to the nearest reflecting surface 30, as seen. Another particular method of achieving a multiplicity of reflecting surfaces is to use a paint 33 where the pigment particles are metallic reflecting particles 34 and these particles may be flat. Examples are "Venus 53" aluminum paint, Titanium Dioxide pigment in a paint and other white paints where the particles preferably have a high refractive index. After exposing, the paint may be washed off (see FIG. 4C). Reflecting particles may be incorporated into a binder that may be removed after exposure by physical means such as by peeling off, by rubbing off or by other means as by dissolving. Such a reflecting material may be made by dispersing "Venus 53" aluminum particles in a thinned rubber cement. By the use of a multiplicity of tiny reflecting surfaces, the interference film photograph Is more easily viewed, the requirement of critical orientation and positioning of the light source, photograph, and eye is reduced.

Previously, attempts have been made to reflect light off the back side of the film as a substitute for the reflecting surface of mercury, but insufficient difference in refractive indices resulted in insufficient reflection. By applying a material of very high index of refraction, substantial light is reflected. For example, liquids may be applied at normal room temperatures for indices up to 2.06, but above this index solids of low melting temperature may be used. For example, a mixture of sulphur and selenium yields an index of approximately 2.35 (Optical Crystallography, Wahlstrom, Wiley, 1948, p.44).

Paints containing particles of non-metallic materials may also be used as a reflecting material. For example, a paint may contain particles of titanium dioxide with a refractive index 2.72. It is not required that the particles surfaces be immediately next to the interface. The resulting interference photographs are more independent of the viewing angle and of the light source position than were Lippmann's photographs. Single or multiple layered interference films (as for example glass) of high reflectivity may also be used as a substitute for the reflecting surface of mercury.

The customary way of viewing ordinary photographic prints (not interference prints) is by perpendicular incidence. However, as previously mentioned, when an interference print is viewed at perpendicular incidence, the observer sees superimposed images of the photograph and the reflection of his face. One disadvantage of tilting the photograph in order to see a diffuse while surface by reflection from the photograph is that for normal viewing and for best color, the eye should be placed at a perpendicular position to the center of the photograph surface. When this is done, the white diffuse light source cannot be seen Referring to FIG. 5A, one way to view the photograph for best color is to place the eye 40 along a perpendicular erected at the center of the photograph 41 and between the eye and photograph interpose a beam divider 42. The beam divider is placed so that rays from the diffuse light source 43 striking the divider are subsequently directed to the photograph and by reflection from the minute layers are directed to the observer's eye 40. The position of the light source and eye may be interchanged. This arrangement allows considerable movement of the observer without the color becoming washed-out. The observed results may be seen on a projection screen by substituting a glass lens for the eye lens and a screen for the retina of the eye.

Possibly the biggest drawback of all to interference film photographs is the problem of reproduction, Thus, in 1896 Silvanus P. Thompson, in a lecture delivered to the Royal Institution of Great Britain states, "The true photography of colours was only discovered a year or two ago by Professor Lippmann, whose exceedingly precious and beautiful results are individual pictures incapable of being multiplied or reproduced." In 1928, E. J. Wall in Practical Color Photograph states,"... there is no known means of reproducing the results. It has remained therefore a purely laboratory process." In 1946, Francis Weston Sears in Principles of Physics III, Optics, states, "Lippmann color photographs are extremely brilliant, but the plates are difficult to prepare, and of course no prints can be made from them."

Hopes for reproduction of interference photographs may seem hopeless from the beginning. As the explanations proceed, it will be shown that reproduction of interference photographs can be accomplished.

When viewing a Kodachrome photograph by either reflected light or by transmitted light at any angle whatever, the colors appear the same. A Kodachrome of a tomato appears red. Because the Kodachrome color is the same color as the object photographed the film is termed a "color positive", and no modifiers are required because the color is the same in transmitted or reflected light. The term "reflection positive" or "transmission positive" would both apply in this case of Kodachrome. Although Kodachrome is used here as an example, other films may be substituted provided they behave similarly.

When viewing a Kodacolor photograph by either reflected light or by transmitted light at any angle whatever, the colors appear the same. A Kodacolor photograph of a tomato appears green. Because the Kodacolor photograph is not the same as the object photographed, but has complementary colors to be the object photographed, the film is termed a color negative", and no modifiers are required because the color is the same in transmitted or reflected light. The terms "reflection negative" or "transmission negative" would both apply in this case to Kodacolor. Although Kodacolor is used here as an example, and in other parts of the text and claims, it is only an example, and other film trade names may be substituted provided they behave similarly.

When viewing an interference photograph, the situation is much different than when viewing either Kodachrome, or Kodacolor. When viewing an interference photograph by reflected light, the color is the same as the object photographed. An interference photograph of a tomato viewed by reflected light is red. However, when viewing an interference photograph by transmission, the complementary colors are seen or the color of the original object photographed is absent. An interference photograph of a tomato appears green by transmitted light. Hence, depending on the method of viewing, the photograph is either positive or negative, and without modifiers, the interference film cannot be said to be either positive or negative. In order to clarify the phenomenon observed, the following terms are defined. An "interference reflection positive" is an interference photograph which, when viewed by reflected light, yields the same color as the original object photographed. An "interference transmission negative" is an interference photograph which, when viewed by transmitted light, yields the complementary color of the original object photographed or exhibits absence of the color of the original object photographed. An interference photograph as Lippmann produced is both an "interference reflection positive" and an "interference transmission negative". One term or the other may be used in describing the same photograph; usage depends on which feature is under discussion.

In attempting to view an interference reflection positive photograph by reflected light, the photograph acts like a mirror. Suppose the interference photograph includes a brightly lighted white object, as a white sheet of cloth in the sun, and the viewer observes the photograph at perpendicular incidence. Inasmuch as the interference photograph acts like a mirror, the apparent whiteness of the sheet will depend on the amount and color of light reflected from the viewer's face onto the photograph and back to the viewer's eyes. The viewer sees two superimposed images as he observes the photograph. One image is of the photograph and the other image is of the light source.

The classical way of viewing an interference photograph is by reflection and the photograph is purposefully observed at an angle and is not observed at perpendicular incidence. The light source may be an illuminated white surface as a sheet of cloth. Light from the light source strikes the interference photograph, and is reflected from the photograph surface into the eyes of the observer. The observer and the light source are positioned with respect to the photograph so that a perpendicular constructed at any part of the photograph intersects neither observer nor light source. This is the method that Lippmann observed his photographs. By substituting a glass lens for the eye lens and by substituting a screen for the retina of the eye, Lippmann succeeded in providing a projection means that made it possible for a group of people to simultaneously see an image of the photograph. Light forming the projected image was, previously reflected from the surface of the photograph and at an angle to the photograph's surface. Norman Kerr of Eastman Kodak Company, by essentially substituting the lens of a view camera for Lippmann's projection lens, and the film plane of the view camera for the projection screen, succeeded in reproducing an interference photograph and published his beautiful result for all the world to see in the March, 1965, issue of Popular Photography magazine. The film surface in the view camera and the surface of the interference photograph were held parallel in space during exposure. Ektachrome positive color film was used.

Figure 5:
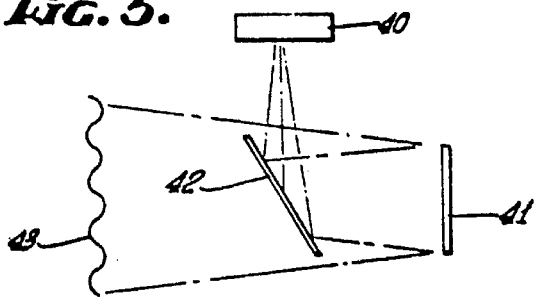
FIGS. 5 and 5A show the use of a beam divider to aid in viewing interference photographs.
Figure 5A:
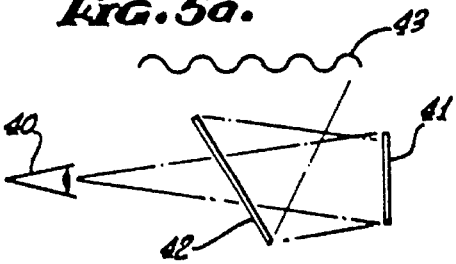

A method of providing essentially perpendicular illumination for viewing is shown in FIGS. 5A and 5B, in which the same numerals are applied to corresponding elements. The images seen may be photographed by substituting a glass lens for the eye lens and substituting a film for the retina, so that 40 also designates such a lens and film. In this manner the image may be seen by looking toward the interference film or the image may be photographed. The projected image using perpendicular illumination may be photographed with either positive or negative color film, an interference film, or a black and white film.

Although the method of producing an interference reflection positive was discovered by Lippmann and although the method of producing an interference reflection negative photograph has not been discussed so far herein, means for viewing and photographing an interference reflection negative follows.

In order to view or photograph an interference reflection negative, light is directed in any number of ways to the photograph surface and the light reflected from the surface is either viewed or photographed. The reflected light may be projected by focusing the image onto a screen represented at 40 in FIG. 5B. The screen may be viewed or photographed. The interference reflection negative photograph may be reproduced (resulting in another interference reflection negative photograph) by imaging light which was reflected from the original's surface onto an unexposed interference film by a lens, the latter two elements also being represented at 40 in FIG. 5B.

Transmitted colors of interference photographs are complements of the reflected colors. This is a distinct difference between interference photographs and Kodachrome or Kodacolor photographs which are the same in color by either transmitted or reflected light. The different colors of the interference photograph which arise, depending on whether light is transmitted or reflected, may be confusing and these effects may be considered as a curiosity peculiar only to interference photographs. However, these very features may be used in making reproductions or in making interference transparencies for use in projectors where light travels through the photograph and is focused onto a screen. Lippmann's interference photographs are not positives in transmission but are negatives in transmission and are not therefore suitable for transmission projection for viewing, but are suitable for photographing and recording on film.

In an interference photograph of a subject that includes a brightly lighted white object, as a white sheet in sunlight, the interference photograph will reflect a large percentage of the incident light and transmit a small percentage of the incident light. In normal black and white photography, the negative transmits a small percentage of the incident light. For this reason an interference reflection positive photograph may be used to make a black and white positive photograph using transmitted light and standard procedures, Colored films may be used also to record the transmitted light from the interference film; for example, Kodachrome, Kodacolor or an interference film may be used.

Figure 6:
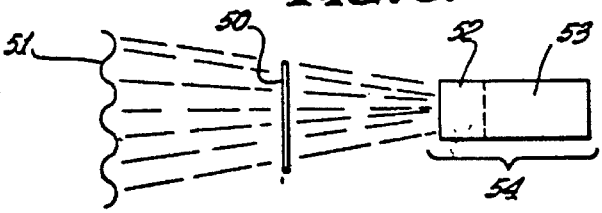
FIG. 6 shows uses of transmission properties of an interference film.

As seen in FIG. 6, light transmitted by an interference transmission negative or positive 50 may be viewed directly by placing the interference photograph 50 so that a light source 51 is placed behind the photograph, A lens 52 may be placed between the observer and the photograph. By looking optically toward the photograph, the transmission colors may be seen. By placing a lens between the interference photograph 50 and a screen 53, the transmitted image may be projected, The transmitted image of the interference photograph may be photographed with a camera represented at 54 directed toward the interference photograph or with the camera directed toward the projected image, When the film in the camera is an interference film, the resulting interference reflection photograph is positive to colors that exposed it, and is an interference transmission photograph negative to the colors that exposed it. This then is a method of producing a reversal, or is a method of producing an interference transmission positive (or interference reflection negative). First a subject may be photographed with a film resulting in a transmission negative or with an interference film. The resulting photograph, a transmission negative, is used to expose a second interference film. The photograph resulting from the second film, a transmission positive (or reflection negative), can then be viewed by transmitted light, which is far easier to view than a reflection positive in reflected light. Not only can it be viewed more easily, but the transmission positive may be used for projection in "standard projectors" (where light is transmitted through the photograph). Contact prints of interference photographs may be made by placing the unexposed film essentially in contact with the photograph.

Interference transmission positive photographs may be made by placing a lens between an unexposed interference film and a transmission negative. An interference transmission negative photograph may be made by placing a lens between an unexposed interference film and a transmission positive.

Either Kodachrome or Kodacolor may be used to record light transmitted by an interference film. If a positive Kodachrome is desired, it should be exposed to light transmitted by an interference transmission positive photograph. If a positive Kodacolor is desired, it should be exposed to light transmitted by an interference transmission negative photograph.

The outstanding qualities of color reproduction by interference films may be used where the slow film speed is of less importance. For example, an interference photograph may be made by light transmitted by either a Kodacolor or Kodachrome photograph; lenses may be used and a screen interface may be used. Light transmitted by the Kodacolor or Kodachrome photograph may be imaged onto an interference film. A positive photograph may be prepared by exposing a negative color film to light transmitted by an interference transmission negative photograph.

In the manufacture of optical transmission filters, gelatin is frequently dyed with various dyes. The colors by transmission are the same as the colors viewed by reflected light, and the color at any particular point does not vary by viewing angle. An interference photograph does not possess these properties.

In glass or gelatin filters, the amount of light transmitted varies with wave length, sometimes in an irregular manner. It would be desirable to be able to create transmission filters possessing any desirable transmission vs. wave length characteristics. Existing interference filters are produced by thermally evaporating various numbers of layers and of various thickness by using transparent materials of various indices of refraction. This work is normally done within a vacuum chamber. These filters are difficult and costly to produce; the number and thickness of layers is mathematically determined, and the thicknesses must be accurately controlled during deposition of successive layers.

In order to make an interference film filter for transmitted light photographically, it is necessary to expose the film by wave lengths that it should not transmit. As an alternate method, a "transmission positive" may be made by first exposing a "transmission negative" to the wave length the "transmission positive" should transmit. The "transmission positive" is produced from the "transmission negative" by one of the methods previously discussed.

A "reflection positive" filter may be made by exposing the photographic interference film by the color it should reflect.

The transmission and reflection characteristics of a filter produced photographically will be the same all over, provided the light rays entering the film are at the same angle to the surface and equally intense. However, if a point source of light is optically at a finite distance from the unexposed interference film, the thickness between the minute layers will increase as the distance increases between the point on the film directly below the light source and the position in question.

Figure 8:
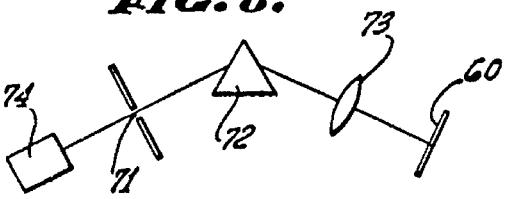
FIG. 8 illustrates the use of a prism in making an interference film filter.

A reflection filter may be made by exposing an interference film to selected wave lengths of light at different portions of the film. For example, as seen in FIG. 8, light from a slit 71, originating from source 74, may be passed through a prism 72 and focused by lens 73 onto an interference film 60. The resulting filter would reflect different colors from different portions of the filter.

Figure 7:
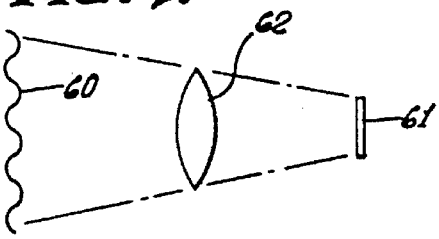
FIG. 7 illustrates the use of a lens in making an interference film filter.

This then provides a method of gradually changing the transmission reflection characteristics from one point to another on a reflection or transmission interference filter produced by optical means and may be accomplished by varying the position of the unexposed film with respect to the light source (the film need not remain on a plane surface, but may be wavy or curved). FIG. 7 shows the light source 60 interference film 61, and a lens 62 that may be used either of which is movable. In order for a filter to transmit or reflect the same color all over the surface, the rays from the light source usually should make the same angle with the surface. In order to accomplish this, a lens 62 may be placed between the light source and film. The reflection—transmission characteristics may be controlled in a predetermined way by moving the lens for controlling the light exposing the film, in quality, intensity, and the angle it makes with the surface. A photographic interference filter may reflect or transmit wave lengths at perpendicular incidence that are longer than the light waves used in creating the filter. This results from purposely exposing the filter during manufacturing to rays that impinge on the film at an angle. The layers thus formed are farther apart than they would have been if the exposing rays impinged on the film at perpendicular incidence.

Photograph interference filters may be made to replicate filters made by other means (gelatin or multi-layer interference filters) by exposing the interference film to light (including infrared) from these other filters.

Due to the fine grain of the emulsions used in interference photography, they are notoriously slow. It is known, however, that thin layers are more sensitive than thick ones. One method of increasing the sensitivity of an emulsion used for interference photography is to use a multiplicity of very thin layers. One method of creating a multiplicity of layers is to successively flow on coating layers onto an emulsion support. Another method is to build up thickness by successively spraying on the emulsion where the droplets may or may not coalesce. Large grains and faster speed may be achieved while maintaining grain thinness in a direction perpendicular to the film surface by using grains that are flattened like pancakes; the flat side of the flattened grains are parallel to the film surface. Flattening may be achieved by rolling or squeezing a thick material or by stretching a thick material into a thinner sheet.

The usages of the following terms herein are as follows:

| | |
|---|---|
| Film | assemblage of materials organized in such a way that some materials are capable of being exposed or already have been exposed by light. |
| Photograph | a film that has been exposed to light. The image may be latent or may be observable. |

I claim:

1. A photo-sensitive element comprising a transparent base, a non-silver halide photosensitive layer and a reflecting layer thereover said reflecting layer comprising indium or gallium.

2. A photo-sensitive element comprising:

(a) a transparent base;

(b) a non-silver halide photosensitive layer; and (c) a reflecting layer thereover, said reflecting layer comprising a metal which is solid at standard temperature, and which contains indium or gallium.

3. A photosensitive element comprising a non-silver halide photosensitive layer and a reflecting layer comprising indium or gallium.

* * * * *